United States Patent [19]

Smith

[11] 4,320,796

[45] Mar. 23, 1982

[54] GRANULAR BED AIR HEATER

[76] Inventor: Richard D. Smith, 2415 South Court, Palo Alto, Calif. 94301

[21] Appl. No.: 4,819

[22] Filed: Jan. 19, 1979

[51] Int. Cl.[3] ..... F28D 3/14

[52] U.S. Cl. ..... 165/1; 165/104.15; 165/104.18; 55/73; 55/390; 55/99

[58] Field of Search ..... 165/104 F, 107, 1, 134 DP, 165/104.15, 104.18; 55/73, 99, 390, 479, 466

[56] References Cited

U.S. PATENT DOCUMENTS

| | | | |
|---|---|---|---|
| 2,678,812 | 5/1954 | Richardson | 165/107 X |
| 2,801,830 | 8/1957 | Frisch | 165/134 DP X |
| 3,305,939 | 2/1967 | Sonnenschein et al. | 165/104 F X |
| 3,561,927 | 2/1971 | Jones, Jr. | 55/390 X |
| 4,083,701 | 4/1978 | Noack | 55/390 X |

FOREIGN PATENT DOCUMENTS

| | | | |
|---|---|---|---|
| 1102785 | 3/1961 | Fed. Rep. of Germany | 165/107 |
| 701544 | 12/1953 | United Kingdom | 165/107 |
| 881105 | 11/1961 | United Kingdom | 165/107 |

*Primary Examiner*—Albert W. Davis
*Attorney, Agent, or Firm*—Phillips, Moore, Weissenberger, Lempio & Majestic

[57] ABSTRACT

An apparatus and process for the transfer of heat from a hot exhaust fluid stream as, for example, produced by a combustion process, into an incoming air stream, to heat the incoming air stream close to the temperature of the exhaust stream. Such high heat transfer efficiency has heretofore not been practiced due to the fact that these exhaust streams frequently contain particulate, water vapor and other condensable vapors. The particulate in the gas fouls high performance heat exchangers and if the temperature of the gas is reduced below its dewpoint, the condensed moisture exacerbates the fouling problem and introduces a corrosion problem of its own. The apparatus of the invention includes a moving granular bed heat exchanger that can cool the exhaust gas to provide enough energy to heat the incoming air close to the temperature of the exhaust gas. Particulate in the hot exhaust fluid stream is filtered in the granular bed. The apparatus can also include means for the removal of condensed water vapor and other vapors should the exhaust gas be cooled below the dewpoint to provide increased heat transfer. The invention can be used with, for example, boilers, furnaces, dryers and the like, to preheat an incoming air stream.

26 Claims, 5 Drawing Figures

GRANULAR BED AIR HEATER

DESCRIPTION

TECHNICAL FIELD

This invention relates to an apparatus and method for transferring heat from a hot exhaust fluid stream, which can contain condensable vapors and particulate, into an incoming fluid stream to heat the incoming stream to a temperature approaching the initial temperature of the hot exhaust fluid stream.

BACKGROUND ART

Large boilers, furnaces, and other combustion devices recover heat from their exhaust gas and use it to heat the incoming combustion air. One device in common use on large boilers to recover heat from the exhaust, and transfer it to the inlet air, is the Ljungstrom air heater. The Ljungstrom air heater is comprised of a regenerative drum rotatably mounted in a housing. The drum is divided into separate compartments through which the hot gases and cool air alternatively flow. The drum has the capacity for heat absorption and release. As the drum rotates, it absorbs heat from the hot gas in one compartment and gives up heat to the cooler air in another compartment. Devices on other boilers include simple shell and tube heat exchangers to accomplish the heat transfer.

None of these heat exchangers cools the hot gas below the dewpoint, because the corrosion caused by condensed moisture, and the fouling due to particulate mixed with the moisture, would shortly render the heat exchangers inoperable. In addition, the moist acid gas flowing downstream of the air heater would corrode an electrostatic precipitator and an induced draft fan, both of which are used to further clean and dispose of the exhaust gas. Also, the moisture in the electrostatic precipitator would cause the collected ash to agglomerate and stick to the walls of any hoppers thereof.

Operating with these limitations, the Ljungstrom air heater, on a large utility boiler, will typically accept hot flue gas from the boiler at 630° F. and cool it to 300° F. If the ambient air is 60° F., it will heat that air to 496° F., far short of the 630° F. exit flue gas temperature.

On many small industrial boilers, small furnaces, dryers and other equipment, heat recovery is not practiced at all because of the high capital cost and operating cost of smaller sized regenerators. Where it is practiced, very simple equipment, with limited effectiveness, is employed.

Several inventions to improve waste heat recovery from exhaust gases have been recorded in the art. Fallon, Jr., et al, U.S. Pat. No. 4,083,398, issued on Apr. 11, 1978, envisions a conventional heat exchanger in the exhaust gas duct, and a second conventional heat exchanger in the air inlet duct, with heat transfer between them by a liquid heat exchange medium. Lange, U.S. Pat. No. 3,953,190, issued on Apr. 27, 1976, teaches the countercurrent flow of hot exhaust gas, from a glass furnace, with granular media to heat the media. Lange also teaches particle collection by the media. However, the media is subsequently fed into the furnace after heating. Also, the temperature of the exhaust gas from the glass furnace is not allowed to drop below its dewpoint.

Morris, U.S. Pat. No. 4,012,210, issued on Mar. 15, 1977, teaches the countercurrent flow of exhaust gas and media for particle removal, but without heat transfer. Combs, U.S. Pat. No. 4,053,293, issued on Oct. 11, 1977, teaches the combination of dust collection and heat exchange from exhaust gas, but does so with a conventional tubular heat exchanger and a special settling chamber.

Olsson, U.S. Pat. No. 1,148,331, issued on July 27, 1915, does not practice exhaust gas energy recovery, but has invented a furnace for indirectly heating a process gas. Olsson teaches the heating of a cool gas by countercurrent contact with heated soiled bodies, such as sand, which has been previously heated by countercurrent contact with a hot gas. Olsson further teaches the recirculation of the sand, and the use of the sand to provide the gas seal between the two heat exchanger vessels. Olsson uses freely falling fine sand to accomplish the heat exchange, rather than a slowly moving packed bed of larger media. Olsson makes no mention of the use of heat from condensing water vapor in his heating gas, nor would his invention allow him to do so. Neither would he be able to remove any particulate from the heating gas. In fact, the falling sand would decrepitate, adding to the particle load in the cooled heating gas leaving his invention.

In the field of petroleum refining, the moving bed pebble heater is a well known device used to heat feedstocks. Goins, U.S. Pat. No. 2,774,572, issued on Dec. 18, 1956, teaches the countercurrent flow of pebbles with hot gas to heat the pebbles in a first chamber, the flow of hot pebbles from the first chamber to a second chamber, the subsequent countercurrent flow of the heated pebbles with cool feedstock in the second chamber to heat the feedstock, and the pneumatic recirculation of the pebbles. Clean fuel is burned specifically to heat the pebbles. The advantge of the heater is that any coking that occurs on the heat transfer surface can be easily burned off and will not build up, as it would in a conventional heat exchanger. The feedstock is heated to a maximum temperature of 650° F., so as to limit coking by the pebble heater, and the maximum temperature of the heating gas is over 1,500° F. Hence, the moving bed pebble heater does not teach energy recovery from a waste gas stream. Also, this pebble heater does not teach condensing water from the heating gas, heating with a dirty gas, or the recovery of contaminants from the pebbles.

Moving bed pebble heat exchangers are also used to cool gases and collect condensables in petroleum refining and air separation operations. In these applications, the gas to be cooled is passed through a moving pebble bed in counterflow with cooled pebbles in such a way that impurities condense on the pebbles and are removed from the product stream. The pebbles may be cooled and cleaned externally from the heat exchanger.

Kasbohm, et al, U.S. Pat. No. 3,023,836, issued on Mar. 6, 1962, teaches a creeping pebble bed cooler which uses an alternate purge gas to cool the pebbles and remove impurities, and slowly moves the condensables into the warmer zone by moving the bed. Gifford, U.S. Pat. No. 2,966,037, issued on Dec. 27, 1960, provides external cooling through the wall of the moving pebble bed container. While both Kasbohm and Gifford teach condensation of vapors in moving pebble bed heaters, they do so solely to remove the material as an impurity, and not for purposes of energy release. Further, the condensate is not removed as a liquid in steady state operation from within the heat exchanger, but cooled to a semi-solid state for removal with the media.

DISCLOSURE OF INVENTION

The present invention is directed to overcoming one or more of the problems as set forth above.

According to the present invention, there is disclosed an apparatus and method for transferring heat from a hot fluid stream which can contain condensable vapors and particulate into an incoming fluid stream to heat the incoming fluid stream close to the temperature of the hot fluid stream. The apparatus includes a heat exchanger adapted to use granular media, which heat exchanger can cool the hot fluid to provide enough energy to heat the incoming air close to the temperature of the hot fluid gas. Particulate in the hot fluid stream is filtered by the granular media. The apparatus can also include means for the removal of condensed water vapor and other vapors should the hot fluid stream be cooled below the dewpoint to provide increased heat transfer.

Now, therefore, the object of this invention is to provide a way to increase the amount of heat that can be recovered from common industrial waste gas streams, and return that heat to the process by preheating the incoming air. Another object of this invention is particulate removal.

Still another object of the invention is to remove condensed vapors should the hot fluid stream be cooled below the dewpoint.

The granular bed air heater can be used to recover heat from almost any fossil fuel combustion device. The apparatus can be used, for example, to recover heat from boilers, furnaces, and the exhaust of dryers, such as, wood veneer dryers, to preheat the incoming air to the dryer.

Because the apparatus is inexpensive to construct, compared to conventional high efficiency heat exchangers, and its technology is well suited to smaller sizes, it will be economical in many industrial applications that do not now employ energy recovery.

An aspect of the invention includes the addition of chemical additives to the granular media to suppress gaseous pollutants.

BEST MODE FOR CARRYING OUT THE INVENTION

Figure 1:
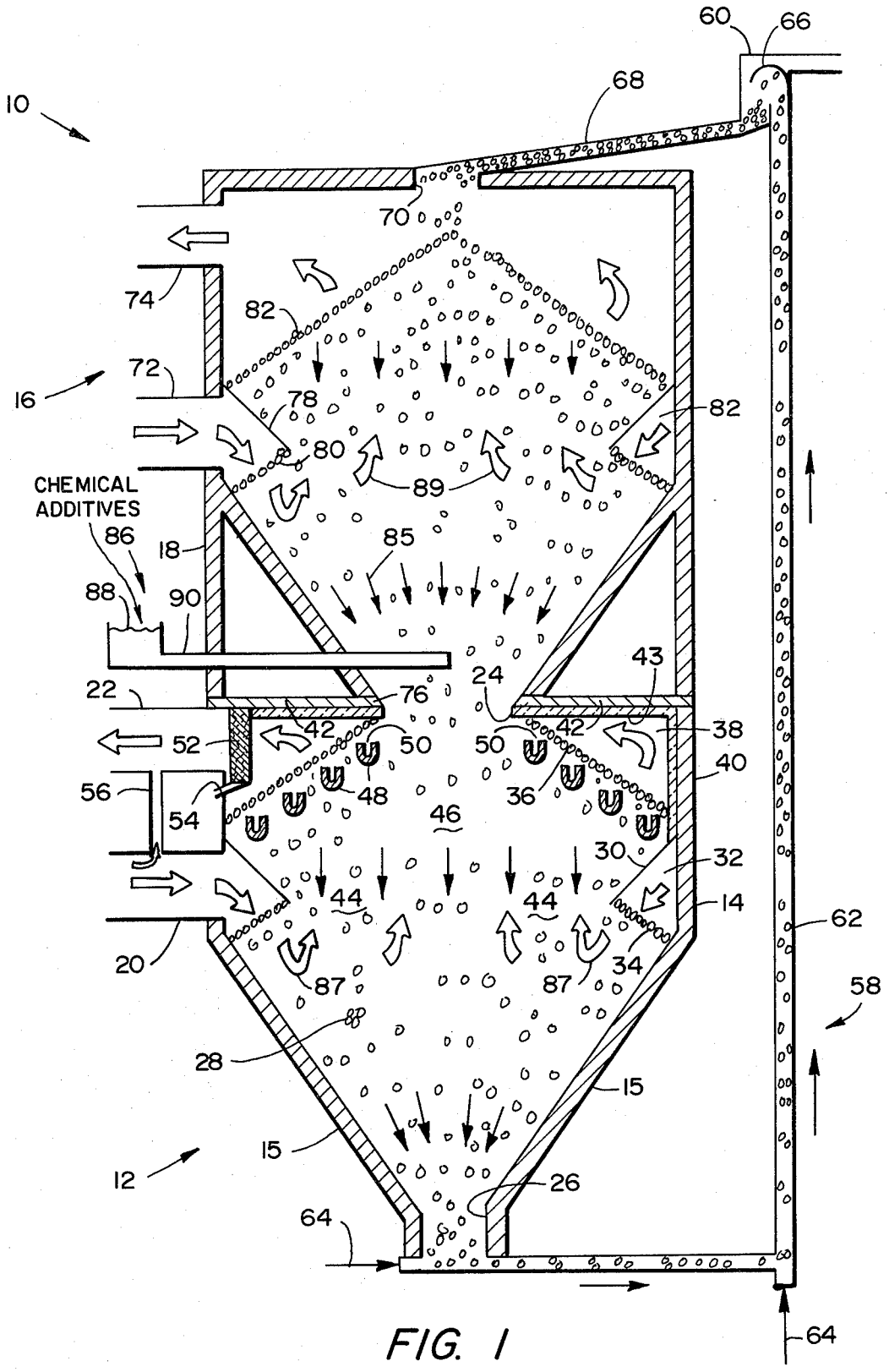
FIG. 1 is a diagrammatical view of an embodiment of the invention, for use with an exhaust gas which can contain water and other vapors, and particulate matter.

With reference to the figures, and in particular to FIG. 1, a granular bed air heater is depicted and generally denoted 10. The air heater 10 includes a first heat exchanger 12 having a first metallic housing 14, and a second heat exchanger 16 having a second metallic housing 18. It is to be understood that other materials, as for example, reinforced fiberglass and the like, can be used for the housings. The second heat exchanger 16 is mounted directly above the first heat exchanger 12. First housing 14 is basically a cylindrical structure which has a conical base 15. The housing 14 is fabricated from, for example, a mild steel, and due to the nature of the heat exchanger there are no close tolerances or high pressure requirements. The second metallic housing 18 is also a generally cylindrical structure and also can be constructed of, for example, the above-indicated mild steel.

The first heat exchanger 12 defines a hot fluid stream inlet port 20 which is adapted to receive, for example, hot combustion exhaust gases which can contain, for example, vapor including water vapor and other particulate matter and the like. First housing 14 also includes a fluid stream outlet port 22. Located at the upper end of first housing 14 is a media inlet port 24, and located at the lower end of housing 14 at the apex of conical base 15 is a media outlet port 26. As will be described further, the flow of the hot fluid from the inlet port 20 through the granular media 28 and out the outlet port 22 is countercurrent to the flow of media from the media inlet port 24 to the media outlet port 26. The solid arrows 85 indicate the flow of media and the outlined arrows 87 indicate the flow of the hot exhaust fluid stream. Also, it is to be understood that the hot fluid stream can comprise, for example, exhaust waste gases from a utility boiler, hot gases from an aluminum heat treat furnace, gases from, for example, a wood veneer drying process and the like. In fact, any waste heat, which may contain vapors including water vapor and solid particulate, can be accommodated in the above-indicated heat exchanger.

Returning to the inlet port 20, a truncated conical baffle 30 extends from a portion of the wall 40 of housing 14 directly above said inlet port to define a torus-shaped space 32. Torus-shaped space 32 is also bounded by the housing wall 14 and also a free surface 34 of the granular media. Free surface 34 is essentially established by the natural angle of repose of the granular media as it passes around the baffle 30. The hot fluid stream is provided to the torus-shaped space 32 from the inlet port 20 and subsequently penetrates the free surface 34 of the granular media 28 and flows upwards through the media, exiting the media at another free surface 36. Free surface 36 is also essentially established by the natural angle of repose of the granular media as the media enters the heat exchanger from the media inlet port 24. It can be seen from FIG. 1 that an additional torus-shaped space 38 is defined by the side cylindrical wall 40 of the housing, the ceiling 42 of the housing and the heretofore mentioned free surface 36 of the media. This torus-shaped space 38 is in fluid communication with the outlet port 22. The particulate matter, which is contained in the hot fluid stream entering the inlet port 20, is deposited on the cool media, which media enters through the media inlet port 24 and flows in pack to the media exit port 26. As the media is in constant downward motion, the media is constantly being renewed, providing new media surfaces to prevent particulate buildup and plugging of the heat exchanger. The majority of the particulate will be deposited on the media immediately downstream of the free surface of the media and immediately adjacent to the hot fluid stream inlet port 20. This area is defined as the particulate collection zone and is designated by the numeral 44. Some of the particulate will remain entrained in the gas as it flows through the media to the outlet port 22. However, such particulate will be only of a small amount and will be very fine. Assuming that the hot fluid gases are the product of a combustion process, the temperature of said gases as they enter the inlet port 20 will be well in excess of the dewpoint, so that the hot fluid gases can be cooled several hundred degrees before their dewpoint is reached. Consequently, most of the particulate is collected in a dry state in the particulate collection zone 44 without being fouled by the liquid condensate from said hot fluid stream. The particulate is trapped on the surface of the media and in the intersticies of the media. It is thereby transported downward with the then heated dry media from the particulate collection zone 44 to the media exit 26. It is to be noted that once the media drops a short distance from the free surface 34 and thus drops below the particulate collection zone 44, that gas flow through said media essentially ceases.

Returning to the flow of the hot fluid stream upward through the media, as the gas transfers its heat to the downwardly flowing media, its temperature eventually reaches the dewpoint and moisture begins to condense on the media and in the hot fluid stream. By the time the hot fluid stream has reached a condensation zone 46 which is located between the conical baffle 30 and the free surface 36 of the media, the gas has passed through a sufficient amount of media so that as previously indicated only a small fraction of particulate remains therein.

Condensed moisture will collect in the condensation zone 46 and be supported there by the upward flow of gas through the condensation zone. Further, should condensation fall downwardly towards the higher temperature particulate collection zone 44, the increased temperature would vaporize the liquid and said newly vaporized liquid would again flow upward into the condensation zone 46. It is to be understood that as the granular media has a high surface area to volume ratio of approximately 200 to 300 square feet of surface area per cubic foot of volume, there is good heat transfer from the hot fluid stream to the media.

A plurality of stationary channels 48 is provided in the condensation zone 46 in order to drain the condensate from the media. The stationary channels are provided in fluid communication with a condensate drain port (not shown) which is defined by the housing of the heat exchanger. The channels are located adjacent the free surface 36 of the granular media and essentially are spaced adjacent and along the natural angle of repose of the granular media. The channels are essentially U-shaped in cross-section and have an open side which points upwardly toward the direction from which the media flows. The channels 48 interrupt the upward flow of the hot fluid stream, and hence, allow the condensate which is carried by the stream to fall in the channels and out of the path of the stream as the stream eddies behind the channels and adjacent the open side 50 thereof. The channels may be full of media or may have a coarse screen provided over the open side 50. If the channels are filled with media, the media would eventually be dissolved by the highly acidic environment therearound, which environment will be described more fully hereinbelow, and as the media is dissolved new media will take its place. Further, should in the alternative a coarse screen be provided over the open side 50 of the stationary channels 48, only liquid condensate would be allowed to collect therein. As only a small amount of the particulate is carried into the condensation zone from the particulate collection zone by the stream, the particulate represents only a small fraction of the weight of the media and also only a small fraction of the weight of the condensate. Thus, clogging of the drains or interruption of the media flow at this point is highly unlikely. The moisture condensing from the hot gas stream releases its latent heat to the media, providing substantial media heating.

In FIG. 1, channels 48 are shown in an echeloned configuration. However, it is to be understood that other configurations can be used.

It is to be understood that as the environment about the condensation zone and the free surface 36 of the media is highly acidic, that the walls of the heat exchanger at this point must be coated with a protective coating 43, such as that well known in the chemical process industry, so that the walls of said heat exchanger are not attacked by the acidic environment. Although such walls are expensive, they are only required in the area of the condensation zone. Such linings can include, for example, glass or plastic linings.

The now cooled gas as it leaves the free surface 36 of the media and enters the torus-shaped space 38 which is in fluid communication with the outlet port 22 is saturated with moisture and carries small droplets of liquid water entrained therein. In order to remove this entrained liquid water so as to reduce the corrosive effect of the exhausted gases on downstream gas processing devices such as those depicted in FIG. 3 and including the electrostatic precipitator and the associated conduits, described hereinbelow, a demister 52 is provided across the outlet port 22. The demister 52 removes almost all of the droplets entrained in the gas stream. In a preferred embodiment, the demister is essentially a matrix comprised of, for example, plastic fiberous material, which traps the droplets and delivers them to a conduit 54 through which they are drained for proper disposal. In order to prevent or limit condensation of the fluid stream as it flows in equipment downstream of the granular bed air heater 10, and thus to prevent corrosion of said equipment, a portion of the hot fluid stream which is provided to the inlet port 20 is bypassed through a duct 56 into the saturated fluid stream exiting from the outlet port 22 to reheat this saturated fluid stream to above its dewpoint. To illustrate the advantages of such a bypass duct 56, consider the following.

Any oils and most coals contain a certain quantity of sulfur. The amount can vary from a few parts per million to five percent and more. When the coal is burned, most of the sulfur is oxidized to sulfur dioxide ($SO_2$), but perhaps one to two percent of it is oxidized to sulfur trioxide ($SO_3$). The sulfur trioxide and water have a tremendous affinity for each other, and when temperatures are lowered to the dewpoint and below, the two combine rapidly to form sulfuric acid. The chemistry of the sulfur trioxide-water system is such that a small amount of sulfur trioxide in the gas forms a concentrated acid solution and this process occurs at a temperature significantly in excess of the dewpoint of water alone. For example, if the gas from the combustion of coal had no sulfur trioxide present, its dewpoint would be about 100° F. However, if the coal contained five percent sulfur, the acid dewpoint would be approximately 288° F.

As indicated above, if allowed to condense, the acid in the exhaust gas of a power plant would corrode the downstream equipment which processes such exhaust gas. It is also to be understood that such moisture downstream of the exit port would preclude dust in the electrostatic precipitator from flowing freely, and thus could conceivably plug said precipitator.

As the media leaves the media outlet port 26, the media has a temperature close to the maximum temperature of the hot gas entering at the hot gas inlet port 20. This results from the large surface area of the media per cubic foot of bulk, and also the relatively long time that the media is in contact with the gas at near its maximum temperature.

The media, after it leaves the first heat exchanger 12 is transported by a pneumatic transport system 58 to a disengagement vessel 60. Pneumatic transport system 58 includes a conduit system 62 with appropriately situated pneumatic jets 64 which provide the necessary lifting force to urge the granular media through and up the conduit system 62. The rate that the media exits the media outlet port 26 determines the flow rate of the media through the entire granular bed air heater 10.

In the pneumatic transport system 58, the media and the ash are transported vertically on an upwardly moving column of heated air to the disengagement vessel 60. The air is heated to make up for any loss of heat from the media as it is so transported. The fast moving air in the transport system strips the particulate from the media, a function further enhanced by the generally turbulent motion of the media in the pneumatic transport system. At the top of the transport system, the media is separated from the lift air in the aforementioned disengagement vessel 60 as the media is impacted on a concave shield 66. The granular media flows by gravity from the disengagement vessel 60 in a conduit 68 to a media inlet port 70. The particulate, suspended in the spent lift air, is conducted from the disengagement vessel 60 to a conventional cyclone (not shown) where most of the particulate is removed from the hot air. The hot air can, for example, then be recompressed and returned for another cycle through the pneumatic transport system or returned to a boiler.

The second heat exchanger 16 includes a cool fluid stream inlet port 72 through which ambient air enters and an outlet port 74 through which heated air exits. Further, the second heat exchanger defines a media outlet port 76 which is in communication with media inlet port 24 of the first heat exchanger.

As can be seen in FIG. 1, the second heat exchanger 16 includes a conical baffle 78 which is secured about the internal surface of the cylindrical housing thereof immediately above the fluid stream inlet port 72. As in the first heat exchanger, the conical baffle causes a free media surface 80 to form immediately below the inlet port 72. The free media surface, the conical baffle and the housing define a torus-shaped space 82 which is similar to the torus-shaped space of the first heat exchanger. Also it is noted that the sidewalls of the lower portion of the second heat exchanger are essentially conical and converge to the media outlet port 76.

Ambient air enters through fluid stream inlet port 72 and penetrates the free media surface 80, coming into contact with the coolest media. The air flow turns vertically upward and flows concurrently to the media, exiting the free media surface 84 at a maximum temperature of approximately that of the media due to the large surface area of the media providing for excellent heat transfer. The now-heated fluid stream exits the second heat exchanger through the fluid stream outlet port 74. The outlined arrows 89 depict the flow of the ambient air. Thus, it can be seen that the temperature of the heated air at exit port 74 is close to that of the hot exhaust fluid stream which enters the first heat exchanger through inlet port 20.

As the flowing media progresses below the ambient air inlet port 72, the media is cooled to its lowest temperature. The cooled media then moved further downward, exiting the second heat exchanger through media outlet port 76 and entering the first heat exchanger through media inlet port 74.

If the pressure of the ambient air entering the ambient fluid stream inlet port 72 is close to the pressure of the hot fluid stream exiting the fluid outlet port 22 of the first heat exchanger, there will be little or no leakage flow from inlet port 72 to the outlet port 22. However, normal boiler conditions usually result in the pressure in inlet port 72 of the second heat exchanger being higher than the pressure in outlet port 22 of the first heat exchanger. Under these conditions, there is a net leakage flow of ambient air from the inlet port 72 through the media outlet port 76 and the media inlet port 24 and out through the outlet port 22. Reducing the area of the media outlet port 74 and the media inlet port 24, compared to the cross-sectional area of the first and second heat exchangers, increases the pressure drop of the fluid leakage flow, and hence, reduces the leakage flow. Thus, as is indicated on FIG. 1, media outlet port 76 and media inlet port 24 are restricted.

Still referring to FIG. 1, the second heat exchanger 16 further includes a gaseous pollutant suppression system 86. System 86 includes a reservoir 88 which can contain chemical additives which suppress the above-indicated gaseous pollutants, which are generated in the condensation zone 46 of the first heat exchanger. The suppression system further includes a delivery mechanism 90 which can include, for example, a screw feed mechanism. Thus, if necessary, the gaseous pollutants can be suppressed by the addition of small quantities of active chemicals to the media before it enters the condension zone. The active ingredients would be hydrolized by the condensate and partially dissolved therein. The gas would be scrubbed as it passes through the moisture-laden granular media. The dispensed reactant would either be removed in solution with the condensate or migrate downward with the media, be dried, and removed with the ash particulate. As an example of a chemical additive, limestone can be added by suppression system 86 to suppress sulfur dioxide.

Figure 2:
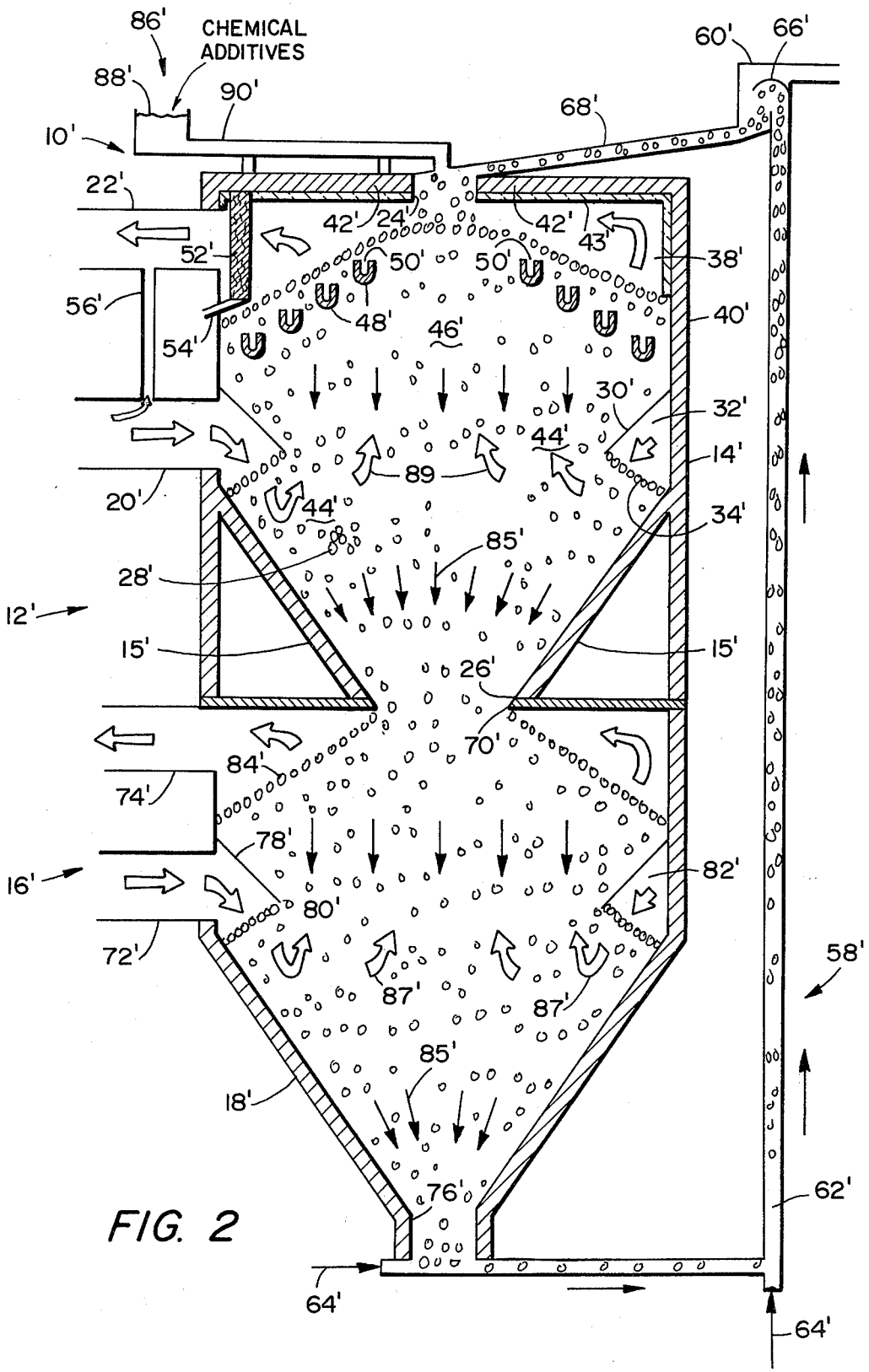
FIG. 2 is a diagrammatical view of an alternate embodiment of the invention, for use with a clean exhaust gas containing water vapor.

An alternate embodiment of the invention is depicted in FIG. 2. Elements in FIG. 2, which are representative of identical elements in FIG. 1, are designated by an identical primed member. This embodiment is preferred for applications where the hot exhaust fluid stream entering the first heat exchanger contains water vapor, but does not contain any significant amount of particulate matter. The exhaust from a gas-fired boiler or an aluminum holding pot heater are appropriate examples. The alternative embodiment is similar to the preferred embodiment except that the first heat exchanger is mounted on top of the second heat exchanger, and the gaseous pollutant suppression system 86' is mounted above the first heat exchanger and adds chemical additives to the media entering said first heat exchanger. Thus, the hot fluid stream passes through the first heat exchanger to heat the media, which media in turn flows to the second heat exchanger, positioned below the first heat exchanger, and there heats the ambient fluid which circulates through the second heat exchanger. The advantage of this arrangement is that cool media is lifted by the pneumatic lift, and hence, air at normal temperatures may be employed to perform the lifting. Another advantage to this configuration is that in boiler applications, due to the positioning of the ports, the pressure differential causing leakage flow from the second heat exchanger 16', to the first heat exchanger 12', through the media inlet port 70' is reduced, and also the leakage flow is in the opposite direction to the media flow, thus further reducing the leakage flow. Again, due to the corrosive environment in the condensation zone, a corrosive-resistant lining is provided in the first heat exchanger adjacent the condensation zone.

INDUSTRIAL APPLICABILITY

To illustrate more clearly the operation of the invention, presented hereinbelow is a description of the operation of a granular bed air heater, retrofitting into a 750 $MW_e$ coal-fired utility boiler.

Figure 3:
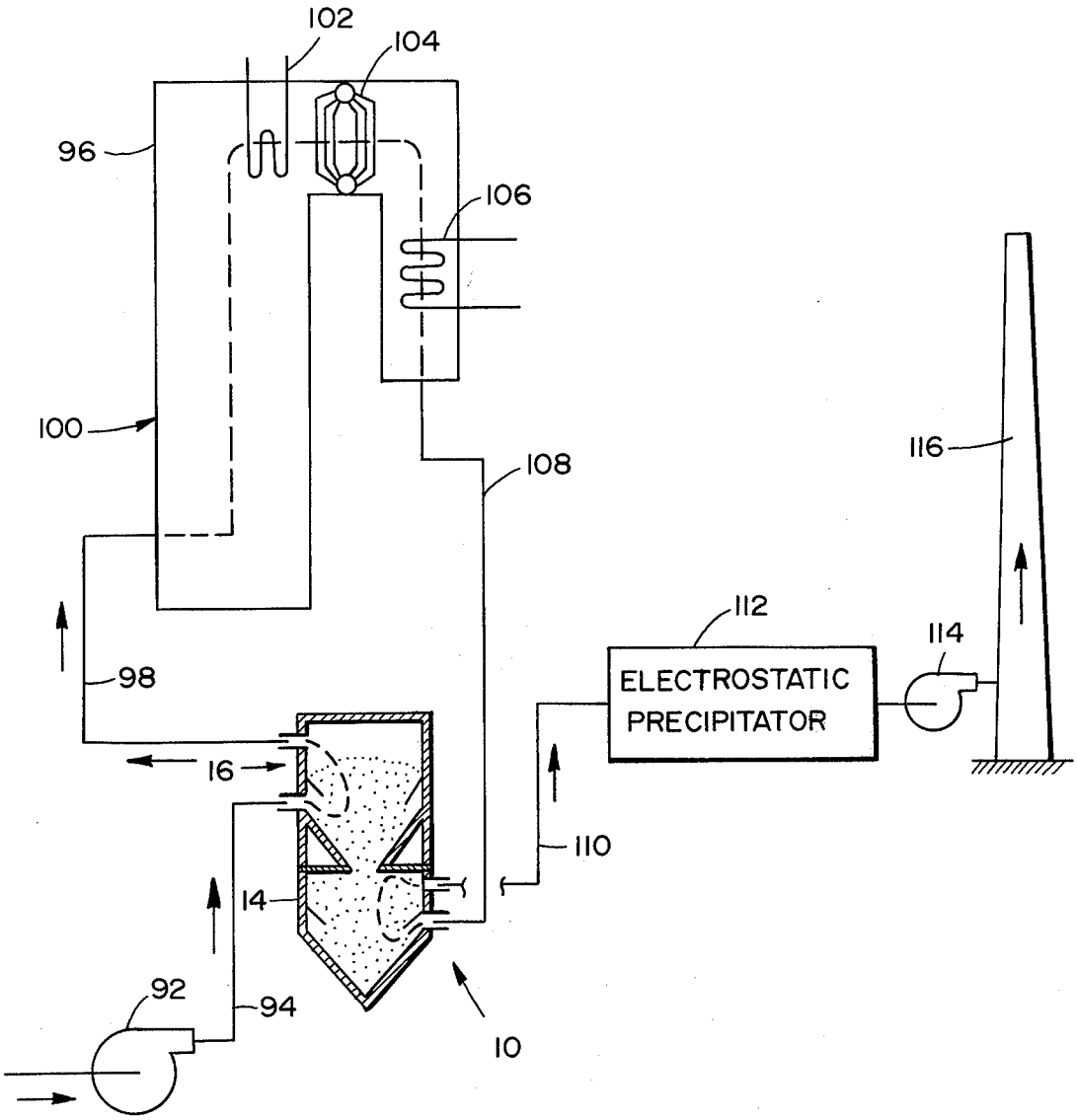
FIG. 3 is a schematic of a boiler system, showing the location of the invention in the system.

FIG. 3 represents a schematic of the gas flow circuit of a utility boiler, showing the location of the granular bed air heater 10 (FIG. 1) in the flow circuit. The ambient air at, perhaps, 60° F. enters a forced draft fan 92 and is provided by conduit 94 to the second heat exchanger 16. Leaving the forced draft fan 92, the pressure of the ambient air is increased to approximately 11.4 inches of water gauge (IWG). Air, which exits the second heat exchanger 16, has a temperature of 615° F. at a pressure of 5 IWG.

The air leaving the second heat exchanger 16 is injected into the boiler 96 by a conduit 98, which is provided in fluid communication with the air exit port of the second heat exchanger. For purposes of this example, boiler 96 has the following components: combustion chamber 100, superheater tubes 102, boiler tubes 104 and economizer tubes 106.

The heated air is injected into boiler 96, where it is mixed with coal and burned. The products of combustion achieve a peak temperature of 2,500° F. The heat is removed from the gaseous product of combustion by the boiler tubes, the superheater tubes and the economizer tubes. The hot flue gas leaves the boiler exit through conduit 108 and is directed to the first heat exchanger 14. The hot gases leaving the boiler are at a temperature of approximately 630° F., and a pressure of −3 IWG. The hot gases contain approximately five percent water from the combustion of the coal, and 3.9 grains per actual cubic foot of particulate from the ash of the coal. The gas has somewhat over one thousand parts per million of sulfur dioxide ($SO_2$) corresponding to the environmental protection limit of 1.2 pounds of sulfur dioxide per million Btu.

The gas which exits the first heat exchanger into conduit 110 at a temperature of 278° F., and is at a pressure of −16.3 IWG. In passing through the granular bed air heater 10, the flue gas from the boiler loses 86% of its moisture and 97% of its particulate matter.

After leaving the granular bed air heater, through conduit 110, the cooled flue gas passes an electrostatic precipitator 112, which removes the remaining particulate matter to meet EPA codes. It further passes through an induced draft fan 114, and up a stack 116, to the atmosphere.

Figure 4:
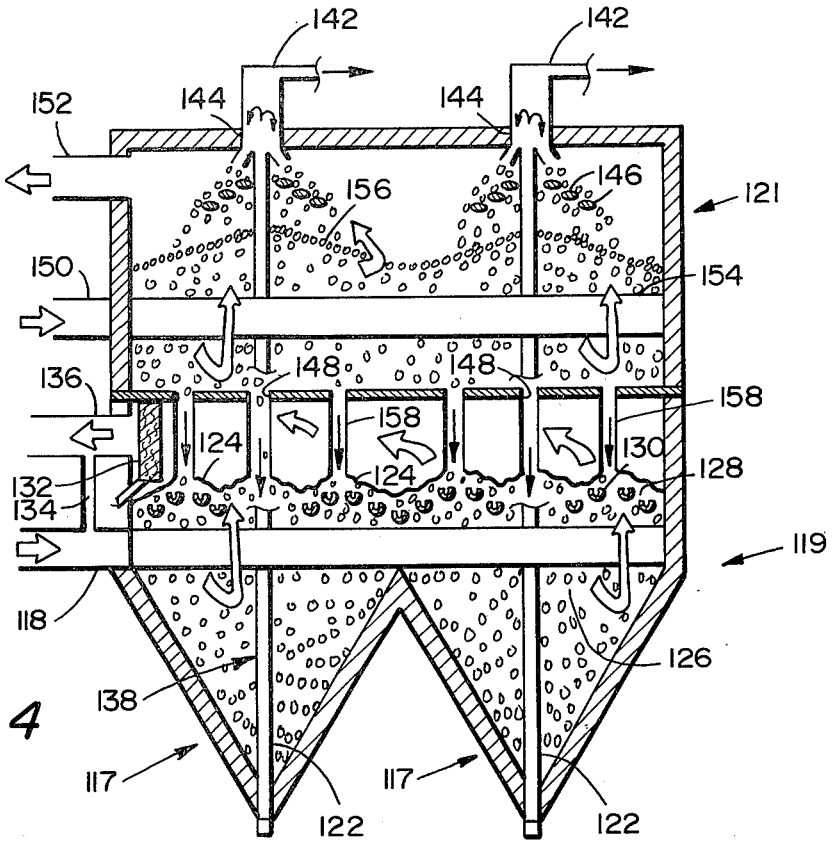
FIG. 4 is a diagrammatic end view of the invention of FIG. 1 incorporated in a design for application to a large utility boiler.
Figure 5:
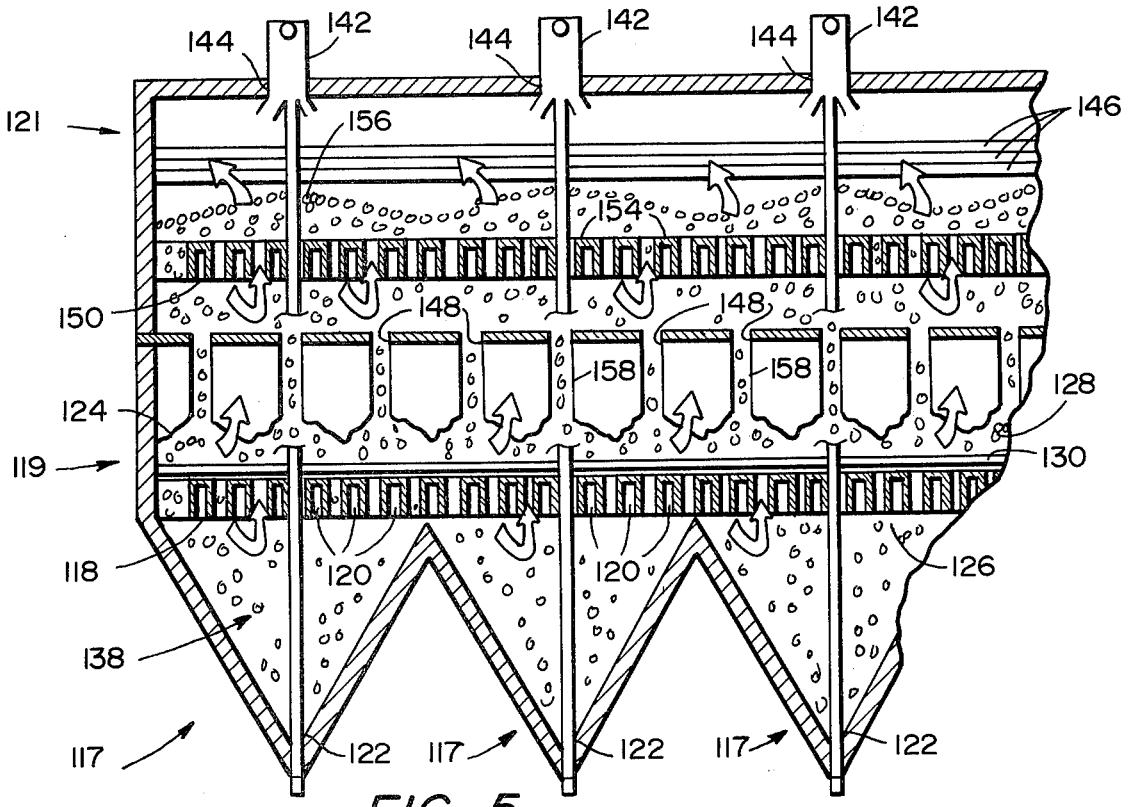
FIG. 5 is a diagrammatic side view of the invention, as incorporated in the design of FIG. 4.

In actual construction, a granular bed air heater for retrofitting into an existing boiler system could, for example, be composed of sixteen identical modules similar to those depicted in FIGS. 1 and 2 and arranged as partially shown in FIGS. 4 and 5. Each of these modules could be, for example, 56 feet long by 14 wide and 17 feet high. FIG. 4 depicts an end view of the above-indicated module arrangement, while FIG. 5 is a partial side view of the module arrangement. Each module would have an ambient air flow rate of approximately 6,200 pounds per minute and a hot fluid stream, or flue gas flow rate, of 6,500 pounds per minute.

Referring to FIGS. 4 and 5, the hot flue gases enter the module arrangement through a hot fluid stream inlet port 118, which communicates with a gas distribution system comprised of, in a preferred embodiment, fifty-five 12 inch by 3 inch, inverted U-shaped channels 120 to distribute the hot flue gas through the media. The gas flows through channels 120 and exits from the open-sided bottom thereof into the media. Thus, the gas can be evenly distributed throughout the media without the media filling the channels 120 and reducing the rate of gas flow therethrough. As the media flows downwardly through the media exit port 122, the hot gases dispersed from the inverted U-shaped channels 120 continually see new clean surfaced media.

The hot fluid stream flows upward through, in a preferred embodiment, approximately two feet of media where it cools to 260° F. before exiting the free media surface 124. It is noted that the conical baffle 30 has been replaced by the plurality of inverted U-shaped channels 120, as such channels provide a better distribution of the incoming fluid stream in the arrangements of FIGS. 4 and 5. As the hot gas flows from the particulate collection zone 126, located about the channels 120, to the condensation zone 128, located beneath the free media surface 124, the gas becomes saturated with moisture. This moisture collects in the plurality of upwardly pointing U-shaped channels 130, which channels allow the moisture to flow out of the heat exchangers. The saturated gas, at 260° F., passes out through a demister 132, which removes the entrained moisture droplets from the saturated gas. In this preferred embodiment, 5% of the incoming hot gas stream, which enters at inlet port 118, is diverted through a bypass conduit 134 to raise the temperature of the gas exiting from the demister 132 through the outlet port 136 to 278° F., reheating the exit gas to approximately 18° F. above the dewpoint thereof.

The hot fluid stream of flue gas entering the module system carries 113 pounds per minute of ash with it, mostly in particles ranging from 4 microns in diameter to 8 microns in diameter. Ninety-seven percent of this ash is deposited on the media in the first 15 inches that the gas travels through the media. This ash is carried with the media through the exit, and disengaged from the media in the pneumatic lift system 138, which is more fully described hereinbelow. Three percent of the ash penetrates the condensation zone 128, representing 0.05 percent of the media by weight in the condensation zone 128.

In the condensation zone 128, 246 pounds of acid-moisture are condensed per minute and drained from each module, through the channels 130. This amount of liquid is 72 times the weight of ash present in this zone. Hence, the channels will be well irrigated and will not plug due to fouling caused by the particulate ash.

The pneumatic lift system 138 contains sixteen individual pneumatic lift columns 140, only some of which are shown in FIGS. 4 and 5. These lift columns are mounted internally to the modules, and deliver the media in the manner heretofore described to individual disengagement vessels 142 from which media is delivered to the media inlet port 144 of the second heat exchanger and the particulate matter is delivered to a cyclone, such as that previously described for proper disposal thereof. As can be seen in FIG. 4, a plurality of echeloned distributor bars 146 are provided immediately below the media inlet port 144, in order to distribute the incoming media throughout the second heat exchanger. As in the second heat exchangers depicted in FIGS. 1 and 2, the second heat exchanger in FIGS. 4 and 5 additionally have media outlet ports 148 and also ambient fluid stream inlet port 150 and fluid stream outlet port 152. Ambient air from a forced draft fan, as that depicted in FIG. 3, enters the ambient fluid stream inlet port 152 and is distributed throughout the media in a distribution system having 55 twelve inch by three inch inverted U-shaped channels 154 similar in design and operation to channels 120 of the first heat exchanger 119. The ambient fluid stream flows through the channels 152 and exit through the open bottom side thereof into the media. The fluid stream subsequently flows upwardly and flows approximately through two feet of media before exiting at the free media surface 156. The air is heated in countercurrent flow with the hot downwardly flowing media.

The media is delivered from the media outlet ports 148 of the second heat exchanger 121 by downcomers 158 which extend into the first heat exchanger 119. The downcomers restrict the rate of flow of the media into the first heat exchanger, and also reduces the leakage flow from the higher pressure second heat exchanger to the lower pressure first heat exchanger. The restricted downcomer causes an increase in the speed of any leakage flow, thus providing a pressure drop and an accompanying pressure seal.

In a preferred embodiment, the pressure in the ambient fluid stream inlet port 150 of the second heat exchanger is 11.4 IWG and the pressure in the hot fluid stream exit port 136 is −16.3 IWG. Thus, the overall pressure differential between these two ducts is approximately 27.7 IWG. Leakage from the second heat exchanger to the first heat exchanger is limited to five percent by the downcomer 158 arrangement previously described. In a preferred embodiment, there are 144 four inch (in internal diameter) media downcomers, each having a length of 2.25 feet.

The media used in the module can be, for example, a natural stone which has been crushed, washed and double-screened. The stone can have a nominal diameter of 3/16 inch, a sphericity of 0.9 and a surface area of 248 square feet per cubic foot of media. The media in this embodiment has a high basalt content to preclude decrepitation during temperature cycling and handling. The bulk density of the media is a 108 pounds per cubic foot. The circulating rate of the media in each module is 7,500 pounds per minute, corresponding to an average downward velocity of 1.5 inches per minute. A complete cycle takes 66 minutes and each module contains 677,000 pounds of media. It is to be understood that other natural and manufactured media can be used in the above-described granular air bed heater. However, it should be remembered that such media should withstand corrosion, wear and thermal stresses.

ADDITIONAL EMBODIMENTS

Other Boiler Retrofits

The granular bed air heater may be retrofitted into oil or gas-fired boilers, as well as coal boilers. Since particle collection is not required, the embodiment of FIG. 2 would be preferred; however, energy savings would be similar.

New Boiler Applications

The 750 $MW_e$ coal-fired utility boiler discussed above assumes that the granular bed air heater was retrofitted into an existing plant. If the heater was included in the design from the conception, additional savings would be possible because the size of the electrostatic precipitator could be reduced, due to reduced particle loading of the exhaust flue gas which is introduced thereto from the granular bed air heater.

Furnace Application

Industry provides gas and oil-fired furnaces for a variety of purposes. Most of these small furnaces do not have any type of energy recovery device on them. Results will vary with each installation, but the granular bed air heater should provide sufficient fuel savings to be an economical addition to most furnaces. For example, if no exhaust heat recovery is practiced and the exit flue gas temperature is 1,100° F., natural gas savings of 20% are possible with the addition of a granular bed air heater.

Dryer Application

In many industrial drying applications, heat is applied to the substance to be dried, along with a flow of ambient air to carry the moisture away. The granular bed air heater can capture the heat of the exhaust and use it to preheat the incoming air. In certain processes, such as the drying of wood veneer, the cooled gases would be scrubbed in passing through the condensation zone, eliminating or greatly reducing the blue haze (condensed hydrocarbons) associated with such a process.

Other aspects, objects and advantages of this invention can be obtained from a study of the drawings, the disclosure and the appended claims.

I claim:

1. An apparatus for transferring heat from a hot fluid stream which can contain water vapor, solid particulate and other condensable vapors and the like to a granular media and for transferring heat from the granular media to another fluid stream comprising:

a first heat exchanger including a first housing which defines a first fluid inlet port adapted to be connected to the hot fluid stream and a first fluid outlet port, wherein said housing further defines a first media inlet port and a first media outlet port;

wherein said first heat exchanger includes means for the removal of particulate from the hot fluid stream;

a second heat exchanger including a second housing which defines a second fluid inlet port adapted to be connected to the another fluid stream and a second fluid outlet port, wherein said housing further defines a second media inlet port and a second media outlet port;

means for delivering media from the first media outlet port to the second media inlet port; and means for adding chemical additives to suppress gaseous pollutants in the first heat exchanger.

2. The apparatus of claim 1 including second means for delivering media from the second media outlet port to the first media inlet port and wherein said second delivery means includes means for restricting fluid leakage flow between the first heat exchanger and the second heat exchanger.

3. The apparatus of claim 2 wherein said restricting means includes a downcomer unit.

4. The apparatus of claim 1 wherein the means for delivering media from the first media outlet port to the second media inlet port includes means for restricting fluid leakage flow between the first heat exchanger and the second heat exchanger.

5. The apparatus of claim 1 wherein said first heat exchanger includes means for the removal of condensed water vapor and other vapors.

6. The apparatus of claim 5 wherein the means for the removal of condensed water vapor and other vapors includes at least one channel.

7. The apparatus of claim 1 wherein said first housing includes demister means for removing moisture from the fluid stream exiting through the first fluid outlet port.

8. The apparatus of claim 1 wherein the first heat exchanger is mounted to and above the second heat exchanger, wherein the means for delivering media from the first media outlet port to the second media inlet port includes restricted conduit means for restricting media flow and fluid stream leakage between the second and first heat exchanger, and the apparatus, including means for delivering media from the second media outlet port to the first media inlet port, wherein said means includes means for lifting the media to the first media inlet port.

9. The apparatus of claim 1 wherein the second heat exchanger is mounted to and above the first heat exchanger, wherein the means for delivering the media from the first media outlet port to the second media inlet port includes means for lifting the media to the second media inlet port, and the apparatus including means for delivering media from the second media outlet port to the first media inlet port, wherein said means includes restricted conduit means for restricting media flow and fluid stream leakage between the second and first heat exchanger.

10. The apparatus of claim 1 wherein said first heat exchanger includes means for diverting some of the hot fluid stream entering the first fluid inlet port to the first fluid outlet port.

11. The apparatus of claim 1 wherein the means for delivering media from the first media outlet port to the second media inlet port includes means for separating particulate entrained with the media as the media passes through the first heat exchanger.

12. The apparatus of claim 1 including means for delivering media from the second media outlet port to the first media inlet port and wherein said means includes means for separating particulate entrained with the media as the media passed through the first heat exchanger.

13. An apparatus for transferring heat from a hot fluid stream which can contain water vapor, solid particulate and other condensable vapors and the like to a granular media comprising:

a housing which defines a fluid inlet port adapted to be connected to the hot fluid stream and a fluid outlet port, wherein said housing further defines a granular media inlet port and a media outlet port;

means for the removal of condensed water vapor and other condensed vapor from the housing, said removal means including at least one channel positioned in said housing; and wherein the channel has an open side, which open side is oriented upwardly such that condensed water vapor and other condensed vapors can collect therein.

14. The apparatus of claim 13 wherein the removal means includes a plurality of U-shaped channels.

15. The apparatus of claim 13 wherein the fluid inlet and outlet ports and the media inlet and outlet ports are positioned such that the flow of the hot fluid stream is countercurrent to the flow of the granular media.

16. The apparatus of claim 13 including means for demisting the hot fluid stream exiting said fluid outlet port.

17. The apparatus of claim 13 including means for diverting some of the hot fluid stream from the fluid inlet port to the fluid outlet port.

18. The apparatus of claim 13 including means for distributing the hot fluid stream through the granular media, said distributing means in fluid communication with the hot fluid stream inlet port.

19. The apparatus of claim 18 wherein the distributing means include at least one channel having an open side facing in any direction other than the direction of flow of the granular media.

20. A method for transferring heat from a hot fluid stream which can contain water vapor, solid particulate and other condensable vapors and the like to a media and for transferring heat from the media to another fluid stream comprising the steps of:

passing the hot fluid stream through a first heat exchanger having a first bed of moving media so that the hot fluid stream heats the media;

condensing and removing the water vapor and other condensable vapors;

passing the heated media into a second heat exchanger;

passing the another fluid stream into the heat media in the second heat exchanger to heat the another fluid stream; and, adding chemical additions to the media prior to introducing the media into the first heat exchanger to suppress gaseous pollutants.

21. The method of claim 20 including the step of:

removing the solid particulate from the media as the media passes from the first to the second heat exchanger.

22. The method of claim 20 including the step of:

returning the media from the second heat exchanger to the first heat exchanger.

23. The method of claim 20 including the step of:

restricting fluid stream leakage flow between the first heat exchanger and the second heat exchanger as the media is returned to the first heat exchanger.

24. The method of claim 20 including the step of:

restricting fluid stream leakage between the first heat exchanger and the second heat exchanger as the media passes to the second heat exchanger.

25. The method of claim 20 including the step of:

demisting the fluid stream exhausted from the first heat exchanger.

26. The method of claim 20 including the step of:

diverting some of the hot fluid stream provided to the first heat exchanger to the fluid stream exiting the first heat exchanger.

* * * * *